US005116258A

United States Patent [19]

Vennik

[11] Patent Number: 5,116,258

[45] Date of Patent: May 26, 1992

[54] COLLAPSIBLE UMBRELLA

[75] Inventor: Johan Vennik, Breda, Netherlands

[73] Assignee: Nijkamp B.V., Breda, Netherlands

[21] Appl. No.: 574,148

[22] Filed: Aug. 28, 1990

[51] Int. Cl.[5] ..... A45B 11/00

[52] U.S. Cl. ..... 135/20.3; 135/21

[58] Field of Search ..... 135/19.5, 21, 15.1, 135/20.3, 19, 16

[56] References Cited

U.S. PATENT DOCUMENTS

| | | | |
|---|---|---|---|
| 344,094 | 6/1886 | Fosburgh | 135/21 |
| 373,809 | 11/1887 | Blunt | 135/21 |
| 2,951,492 | 9/1960 | Small | 135/37 X |
| 3,383,814 | 5/1968 | Rowe | 135/21 X |
| 4,586,525 | 5/1986 | Glatz et al. | 135/21 X |

FOREIGN PATENT DOCUMENTS

| | | | |
|---|---|---|---|
| 3307718A1 | 9/1984 | Fed. Rep. of Germany . | |
| 339163A1 | 3/1985 | Fed. Rep. of Germany . | |
| 784815 | 7/1935 | France . | |
| 1030826 | 6/1953 | France | 135/21 |
| 1033163 | 7/1953 | France | 135/21 |
| WO82/03538 | 10/1982 | PCT Int'l Appl. . | |

*Primary Examiner*—David A. Scherbel
*Assistant Examiner*—Lan Mai
*Attorney, Agent, or Firm*—Wells, St. John & Roberts

[57] ABSTRACT

The invention concerns a collapsible umbrella against for instance sunlight, rain and so on, consisting of a shaft and a number of ribs fixed pivotally relative thereto for supporting fabric-like material, which ribs are each pivotally connected to the one end of a rod-like stretcher, the other end of which is displaceable in lengthwise direction of the shaft characterized in that said shaft takes a hollow form and serves as guiding for a common control rod connected to the stretcher rods. It is suitable for stationary use and it is suspended from above to avoid obstruction of the space underneath the umbrella.

To allow the umbrella to be collapsed the shaft thereof is hollow and it accommodates a common control rod connected to all the stretchers, the other sides whereof are connected with the ribs. The umbrella is suspended from a carrier pivotally connected to a standard. Such a standard may bear several umbrellas.

5 Claims, 3 Drawing Sheets

COLLAPSIBLE UMBRELLA

Figure 1:
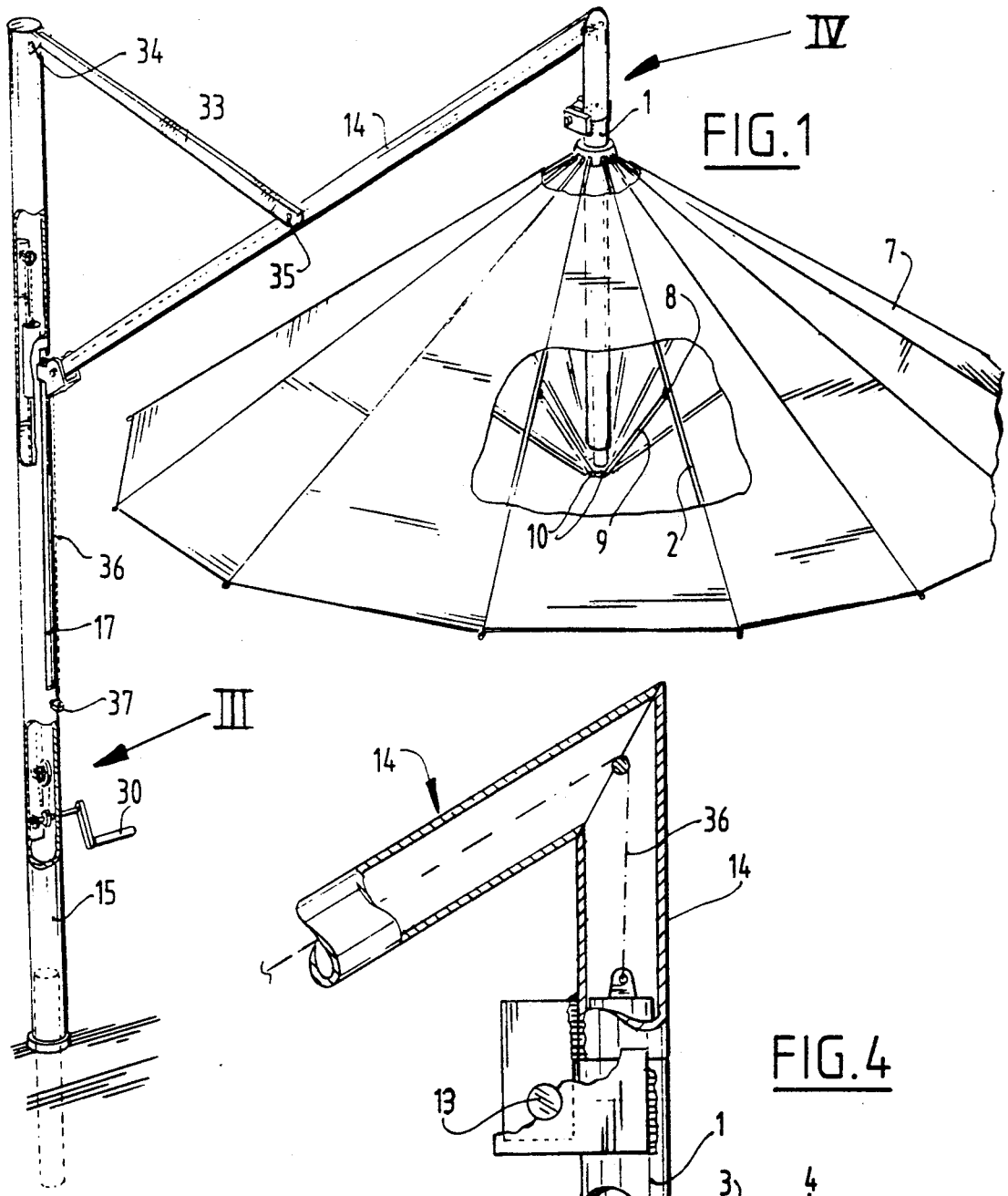

The invention relates to a collapsible umbrella against for instance sunlight, rain and so on, consisting of a shaft and a number of ribs fixed pivotally relative thereto for supporting fabric-like material, which ribs are each pivotally connected to the one end of a rod-like stretcher, the other end of which is displaceable in lengthwise direction of the shaft.

Such a construction is frequently used in umbrellas and the like, wherein the shaft is provided with a handle and wherein above the handle a sleeve-like slide element is used that is slidable along the shaft and to which is attached the other end of the rod-like stretchers.

Likewise known is an embodiment wherein the umbrella is fixed to a central shaft which is provided with a foot, which results in the drawback that the space under the umbrella cannot be fully utilized.

The invention has for its object to embody such an umbrella in a larger dimension and dispose it in a stationary position, wherein the operation for the user remains very simple, the whole construction is quite sturdy and therefore resistant to wind load and the like.

The umbrella according to the invention is distinguished in that the shaft takes a hollow form and serves as guiding for a common control rod connected to the stretchers.

This telescopic construction ensures that the space beneath the umbrella is not obstructed by construction parts.

In a first embodiment the top end of the shaft is pivotally attached to a carrier, wherein the length of the control rod is greater than that of the shaft, wherein the carrier is moreover provided with a space for receiving the top end of the control rod. In this embodiment the control rod will therefore not only guide the ribs but also provide a locking in the erected position of the umbrella.

In a further embodiment the carrier is itself pivotally attached to a standard whereby the umbrella can be easily carried from the erected position into a collapsed position without the umbrella occupying much space in the collapsed position.

In order to assist simple operation a cord or like flexible means is trained via the hollow carrier to the top end of the control rod and fastened thereto. Erecting and locking is herewith effected using the same cord.

The invention is not limited to a single umbrella but can also be applied to a group of collapsible umbrellas provided with a common standard.

Figure 4:
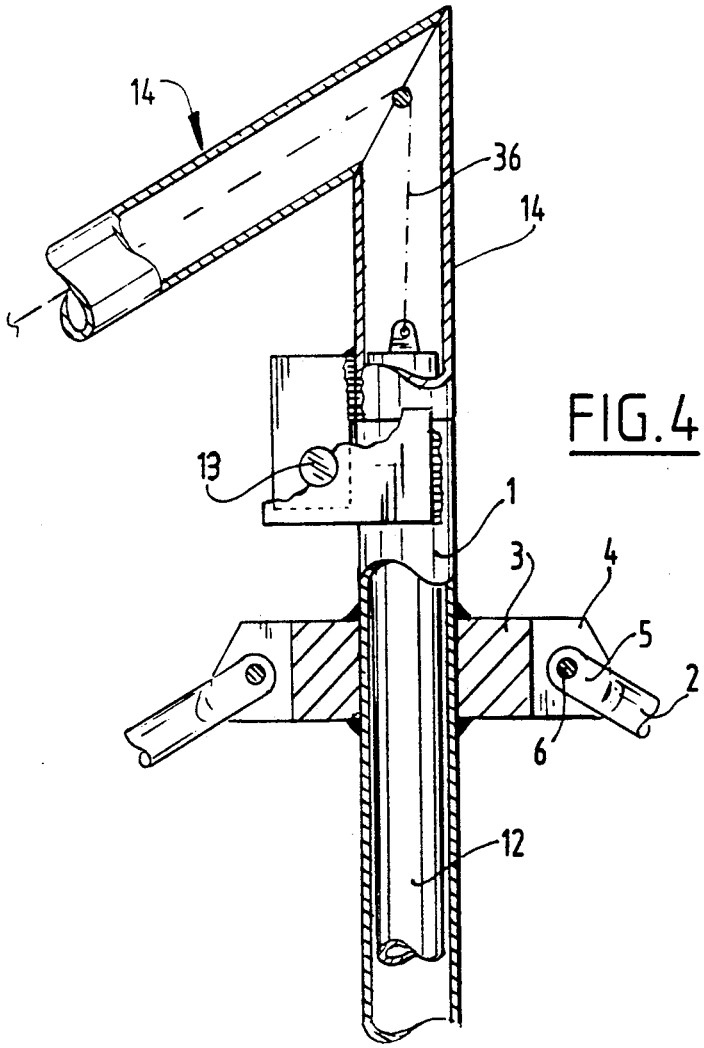
Figure 2:
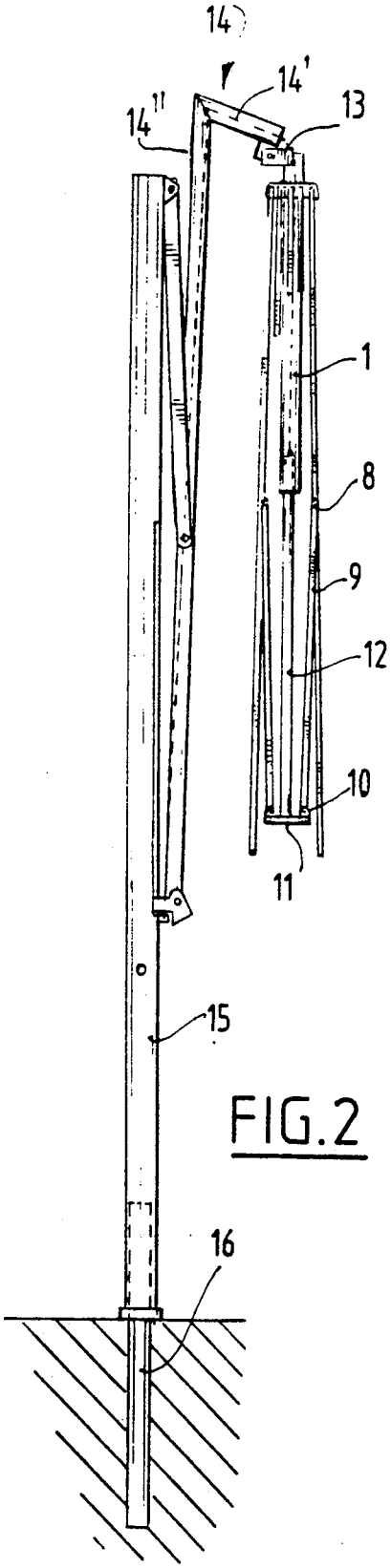
Figure 3:
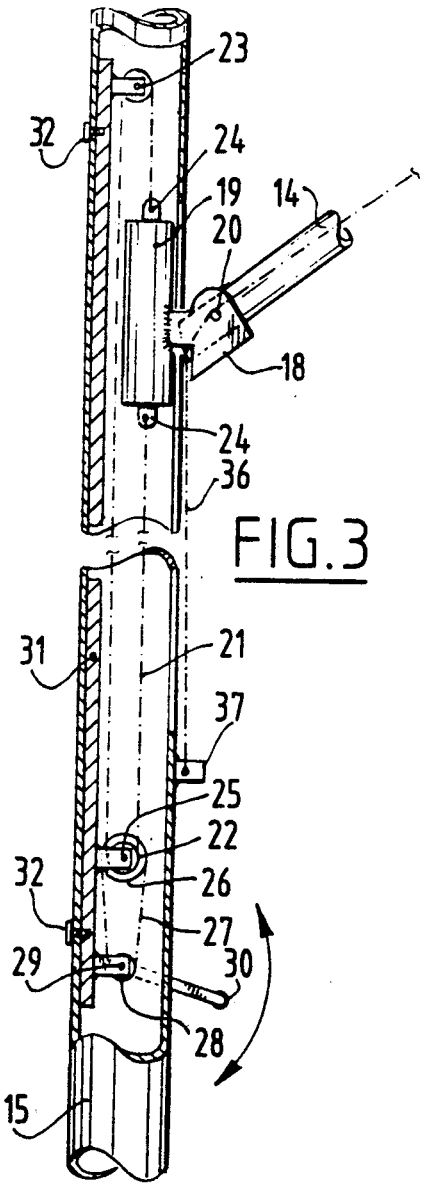
Figure 5:
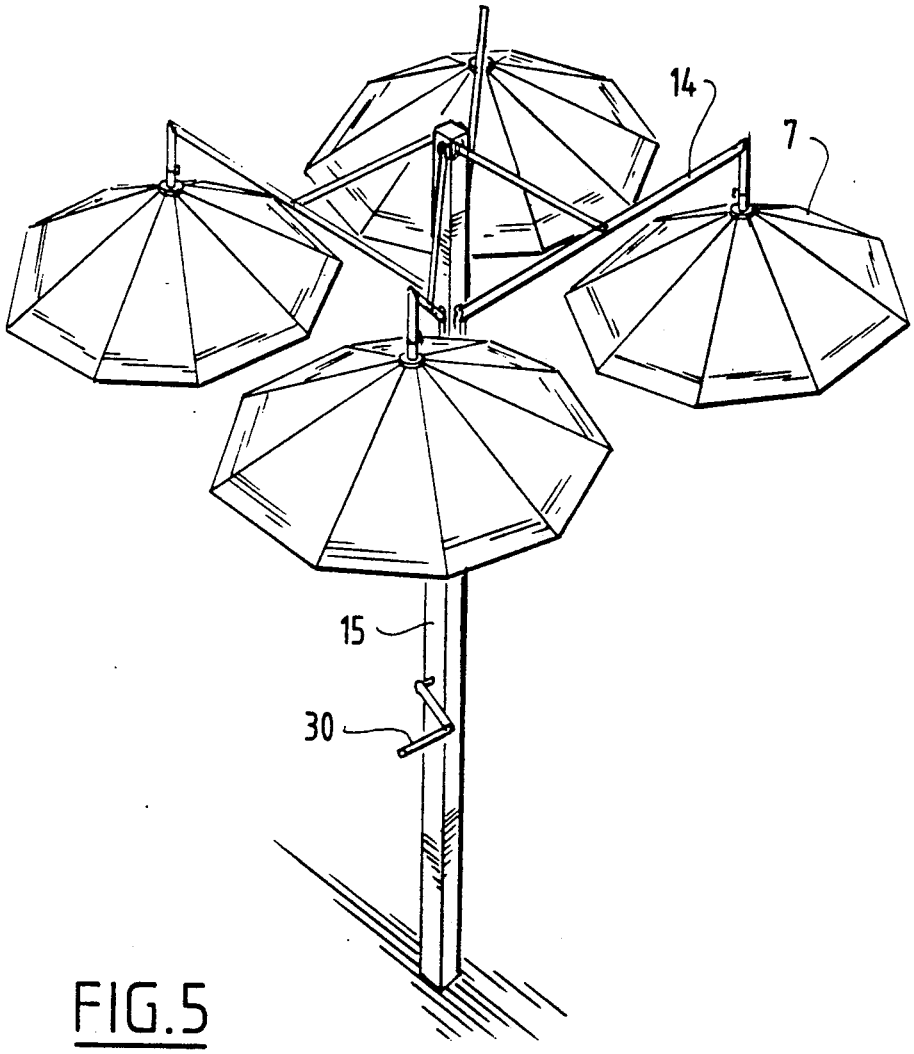

The invention is further elucidated in the figure description hereinafter of a number of embodiments. In the drawing:

FIG. 1 shows a perspective top view of an embodiment of a single collapsible umbrella according to the invention, FIG. 2 is an upright side view of the different construction parts in collapsed position without the fabric-type material arranged on the ribs, FIG. 3 is a detail of the standard in cross section with the bottom end of the carrier arranged slidably and pivotally thereon, FIG. 4 is an upright section of the free end of the carrier with the standard for the umbrella attached pivotally thereto, FIG. 5 shows a perspective top view of a second embodiment of a group of umbrellas according to the invention provided with a common standard.

The same components are designated in the figures with the same reference numerals.

The umbrella according to the invention consists of a shaft 1, close to the top end of which a number of ribs 2 are pivotally attached. The pivot construction can be embodied in any suitable manner and falls otherwise outside the scope of the invention. In the embodiment shown, see FIG. 4, it is a ring 3 fixed to the top end of the standard and provided with radially oriented slots 4 into which the top end 5 of a rib 2 can be mounted for pivoting about the pivot pin 6.

The ribs 2 serve to support a canopy of fabric-like material 7. This fabric-like material may also be of any random type, for instance textile or plastic foil, this depending on the use of the umbrella.

Arranged close to the middle of each rib 2 is a second pivot point 8 to which is pivotally attached the one end of a rod-like stretcher 9. The other end 10 of the rod-like stretchers is fixed to a ring 11 which is similar to the ring 3 and which is attached to the bottom end of a control rod 12 arranged slidably in the hollow shaft 1.

The top end of the shaft 1 is fixed pivotally with a pivot 13 to a carrier 14, which has an L-shaped form in the embodiment shown. The short leg 14' of the carrier 14 takes the form of a hollow profile preferably corresponding with the profile of the shaft 1. The long leg 14,, of the carrier 14 is suspended on a standard 15. The standard 15 can be fixedly disposed in any random manner, for example by means of a ground anchor pin 16. The standard 15 is provided in the standing side wall with a slot 17, see FIG. 3, through which can pass a bracket 18 of a slide member 19 slidable in the hollow standard 15. The bracket 18 serves to receive the bottom end of the carrier 14 for pivoting about the pivot pin 20. The slide member 19 in the hollow standard 15 is carried by a flexible element 21 trained around two reversing pulleys 22 and 23, which are mounted in the hollow standard. The flexible element 21 is fastened to the top and bottom of the slide member 19 by means of the eyes 24.

The bottom reversing means 22 is bearing mounted on a shaft 25 which is also provided with a wheel 26 around which is trained a second flexible element 27. This flexible element is also guided round a drive pinion 28 that is fixed nonrotatably to a shaft 29 rotatably mounted in the hollow standard 15, however with one end protruding outside the standard 15 and with a handle 30 being provided on the free end.

Although the entire mechanism as described above can be mounted separately in the standard 15, the mechanism can also be mounted on a sub-frame in the form of an elongate plate 31, which sub-frame 31 can be fixed in the standard 15 by means of bolts 32.

Referring back to FIGS. 1 and 2 it can be seen that the carrier 14 is attached pivotally at the bottom end to the bracket 18 and is further supported by a bar strut 33 which is coupled pivotally at one end to the top end of the standard 15 by means of a pivot pin 34 and at the other end halfway along the carrier 14 by means of the pivot pin 35.

Finally, it is noted that a flexible element 36 extends from a fixed point 37 on the outside of the standard 15 through the hollow carrier 14 and the shaft 1 to the top end of the control rod 12.

The above described mechanism for erecting and collapsing the umbrella operates as follows:

Starting from the position in FIG. 2 wherein the umbrella is in collapsed state, by turning the handle 30 and therefore the pinion 28 the flexible element 21 can be turned by means of the transmission mechanism 27 such that the slide member 19 moves upward in the standard 15. The bottom end of the carrier 14 thereby also moves upward along the standard 15 and will gradually assume the position as in FIG. 1, wherein the carrier extrudes from the standard 15. Because of the fixed disposition of the flexible element 36 on the bottom end 37 on the standard 15 the control rod 12 will be pulled into the shaft 1 as the carrier 14 moves outward, whereby the ribs 2 will begin to erect on account of the outward force acting on the stretcher rods 9. As a result of the pivoting action between the shaft 1 and the short leg 14, of the carrier 14 the shaft 1 remains in vertical position when the carrier 14 moves outward relative to standard 15. The erecting of the umbrella and outward movement of the carrier 14 can continue until the short leg 14' lies in line with the shaft 1, in which position the top end of the shaft 1 closes onto the bottom end of the carrier 14. This position is shown in FIG. 4. In this position the control rod 12 will also be pulled so far upward by the flexible element 36 that the top end thereof extends into the hollow leg 14' of carrier 14.

In the erected position of the umbrella 1 as in FIG. 1 the shaft 1 is therefore locked relative to the short leg 14' of the carrier by means of the control rod 12, which prevents the shaft 1 fitting loosely around the pivot pin 13.

The collapsing of the umbrella takes place in reverse sequence, primarily by reverse rotation of the handle 30, causing the slide member 19 to descend and therefore collapsing the carrier 14, whereby the control rod 12 can drop out of the carrier 14, the pivot 13 is therefore released and the umbrella can collapse.

FIG. 5 shows an embodiment wherein arranged on the standard 15 are four carriers 14, on each of which an umbrella 7 is suspended. The carriers 14 are up and downwardly movable along the standard 15 in the manner according to FIG. 1 by means of turning the handle 30, wherein it is noted that the standard displays on four sides a slot 17 through each of which protrudes a bracket 18 on a common slide member 19. It is therefore possible by turning one handle 30 to erect or collapse all four umbrellas 7 simultaneously.

The invention is not limited to the above described embodiment.

I claim:

1. Collapsible umbrella against for instance sunlight, rain and so on, comprising:

a shaft and a number of ribs fixed pivotally thereto for supporting a fabric-like material, which ribs are each pivotally connected to a rodlike stretcher, a bottom end whereof is displaceable in lengthwise direction of said shaft, wherein said shaft takes a hollow form and serves as a guide for a common control rod slidably received within the shaft, said shaft having a top end and a length dimension, said control rod being connected to said stretcher rods:

wherein the control rod has a length form a top end that is greater than said length of said shaft;

a hollow carrier for axially receiving the top end of the control rod, said carrier being pivotally attached to the shaft at a location below the top end of the shaft and pivotable thereon to a position angularly spaced from the shaft; and wherein the carrie space for receiving the top end of said control rod is positioned to selectively lock the shaft against pivotal motion when the control rod top end is received in said space.

2. Collapsible umbrella as claimed in claim 1, wherein the carrier is pivotally connected to a standard.

3. Collapsible umbrella as claimed in claim 1, a flexible element, fastened with one end to a fixed point and is trained through the standard, the carrier and the shaft to the top end of the control rod.

4. Collapsible umbrella as claimed in claim 3, wherein the fixed point of the flexible element is attached to the standard, wherein the bottom end of the carrier is movable toward and away from said fixed point by means of a slide member displaceable along said standard.

5. A group of collapsible umbrellas, comprising:

a standard;

a plurality of umbrellas mounted to and arranged angularly about the standard, each of said umbrellas including:

a shaft and a number of ribs fixed pivotally thereto for supporting a fabric-like material, which ribs are each pivotally connected to a rod-like stretcher, a bottom end whereof is displaceable in lengthwise direction of said shaft, wherein said shaft takes a hollow form and serves as a guide for a common control rod slidably received within the shaft and having a top end and a length dimension, said control rod being connected to said stretcher rods;

wherein the control rod has a length from a top end that is greater than said length of said shaft;

a hollow carrier pivotably mounted to the standard and normally positioned thereon for axially receiving the top end of the control rod, said carrier being pivotally attached to the shaft at a location below the top end of the shaft and pivotable thereon to a position angularly spaced from the shaft; and wherein the hollow carrier is positioned to selectively lock the shaft against pivotal motion when the control rod top end is received therein.

* * * * *